US007234494B2

(12) United States Patent
Tahil et al.

(10) Patent No.: US 7,234,494 B2
(45) Date of Patent: Jun. 26, 2007

(54) DEVICE FOR FILLING SOLUBLE CONTAINERS

(75) Inventors: Raj Vikram Tahil, Flat Ni. 1, Torpac House, Ameya Park, Boisar-Navapur Road, Boisar Pin-401501, Dist-Thane, Maharashtra (IN); Santosh Puransingh Bhagat, Maharashtra (IN); Poovakkala John Oommen, Maharashtra (IN)

(73) Assignee: Raj Vikram Tahil, Maharashtra (IN)

( * ) Notice: Subject to any disclaimer, the term of this patent is extended or adjusted under 35 U.S.C. 154(b) by 403 days.

(21) Appl. No.: 10/502,105

(22) PCT Filed: Jan. 28, 2003

(86) PCT No.: PCT/IN03/00013

§ 371 (c)(1),
(2), (4) Date: Jul. 19, 2004

(87) PCT Pub. No.: WO03/064264

PCT Pub. Date: Aug. 7, 2003

(65) Prior Publication Data

US 2005/0076969 A1 Apr. 14, 2005

(30) Foreign Application Priority Data

Jan. 29, 2002 (IN) ..... 79/MUM/2002
Oct. 31, 2002 (IN) ..... 949/MUM/2002

(51) Int. Cl.
*B65B 1/04* (2006.01)

(52) U.S. Cl. ..... 141/237; 141/100; 141/234; 141/248; 141/266; 53/281; 53/169; 53/390; 53/900

(58) Field of Classification Search ..... 53/468, 53/471, 281, 168, 390, 900, 381.4, 169; 141/2, 141/18, 100, 234, 237, 247, 248, 266
See application file for complete search history.

(56) References Cited

U.S. PATENT DOCUMENTS

| | | | | |
|---|---|---|---|---|
| 3,978,640 A * | 9/1976 | Crossley et al. | ..... | 53/468 |
| 4,089,152 A * | 5/1978 | Zanasi | ..... | 53/281 |
| 5,081,822 A * | 1/1992 | Boyd et al. | ..... | 53/468 |
| 5,321,932 A * | 6/1994 | Sundberg | ..... | 53/468 |
| 5,836,141 A | 11/1998 | Sunberg | ..... | 53/468 |

* cited by examiner

*Primary Examiner*—Timothy L. Maust
(74) *Attorney, Agent, or Firm*—Intellectual Property Law Group LLP; Otto O. Lee; Juneko Jackson

(57) ABSTRACT

A device for filling soluble containers such as capsules comprises an assembly for orienting and separating capsules including double blind capsules which have a longer cap length and shorter body length wherein such assembly has a top sheet for loading the capsules and a bottom sheet for orienting the capsules loaded therein and such said sheets capable of being relatively displaced with respect to each other. Slots are provided in the top sheet for limiting such displacement by setting free configuration for orientation of the capsules. An open closable gate is mounted to the top sheet for enabling easier loading and containment of the capsules within the top sheet, for orienting the capsules. The filler assembly has at least a pair of sheets having profile cut portions and profile-cut strip for gripping the body of the capsules especially capsules having a longer cap length and shorter body length such as double blind capsules.

20 Claims, 10 Drawing Sheets

DEVICE FOR FILLING SOLUBLE CONTAINERS

FIELD OF INVENTION

The present invention relates to the field of filling soluble containers such as capsules. Particularly, the present invention relates to the field of filling materials in the form of non-aqueous liquid, powder, oil, solid, tablets, caplets, foam, gel, granules, smaller capsules into large size capsules and so on especially into capsules made from different materials such as starch, PVA, PEO, etc. More particularly, the present invention relates to a device for filling capsules by conveniently orienting the capsules, opening the cap of the capsules for filling required contents into capsules and thereafter re-closing the filled capsules.

BACKGROUND ART

Numerous attempts have been made to provide a device for filling containers particularly soluble containers such as capsules.

In general, a device for filling a soluble container such as a capsule comprises the following components:

a) Orienter.
b) Filler.
c) Capsule Tray.
d) Powder tray, Powder spreader & Extractor rod.
e) Tamper unit.

The orienter orients the capsules in such a way that caps remain up & bodies in down position. After this, the capsules are transferred from orienter to capsule tray mounted on filler.

The capsule tray keeps all capsules on filler in vertical position. The cap & body of capsules are separated as sliding sheet holds the capsule bodies firmly against separation force generated by lifting of the capsule tray.

Powder tray and powder spreader are provided to ease filling of powder and other filling materials. A tamper unit is provided to ensure uniform filling.

U.S. Pat. No. 5,321,932 discloses an invention entitled "capsule handling system" wherein the sheet sliding mechanism in the orienter generates more friction due to large contact area and therefore sliding is not smooth. Also, positioning of sheets for orienting the capsules is more or less inconsistent. As regards the filler assembly, two thumb screws are used to operate sliding sheet to hold the capsule bodies during separation of cap and body of the capsules. This is an inconvenient and time consuming operation. For filling capsules of other size, adjustment of height of filler base according to cut length of capsule bodies and therefore appropriate adjustment and setting are required which is also a cumbersome operation.

In a capsule filling machine developed and marketed by a company called Feton®, grub screws are used for setting and holding the sheets with respect to base for orienting the capsules. Further, the stroke length of the orienter sheet in this machine is to be adjusted by a thumb screw. This arrangement is quite cumbersome and requires skill on the part of the operator to achieve the above tasks.

Both the machines as developed by Feton and as disclosed in the U.S. Pat. No. 5,321,932 have a closed structure and therefore the operation is not visual and accessibility to jammed capsules becomes difficult.

Further, the above mentioned capsule filling devices are not capable of orienting, separating the cap and body, and filling of capsules which have longer cap length and smaller body length such as double blind capsules.

Other conventional capsule filling machines also suffer from a series of drawbacks either in their configuration and/or function thereby resulting in a poor performance.

Therefore, a need has arisen for requirement of developing a machine which would overcome the drawbacks associated with the existing devices, and which would provide a setting free capsule filling system and which is simple in construction and achieves more efficient performance.

Our inventors, by determined research and intuitive knowledge, for the first time, have introduced a device for filling soluble containers which would provide a setting free capsule filling system and which is simple in construction, easy to operate and achieves more efficient performance than those devices in the state of the art.

OBJECTS OF THE INVENTION

The objects and advantages of the present invention will be apparent from the description appended hereto:

1. An object of the present invention is to provide a device for filling soluble containers such as capsules wherein the device has a simple structure comprising less number of parts to enable easier handling and operation, for filling of capsules.
2. An object of the present invention is to provide a device for filling soluble containers such as capsules wherein the device has a longer life and provides higher output per hour of capsule filling operation.
3. An object of the present invention is to provide a device for filling soluble containers such as capsules wherein the assembly for orienting the capsule has a sheet sliding mechanism which is capable of being operated under minimum contact area and thereby effect smooth and substantially friction free sliding of sheet so as to achieve smooth flow and orientation of capsules.
4. Yet another object of present invention is to provide a device for filling soluble containers such as capsules wherein the sub-assembly for orienting is easily removable and thereby enabling easier cleaning and maintenance.
5. An object of the present invention is to provide a device for filling soluble containers such as capsules wherein the device can be used for orienting, separating cap and body, and filling capsules of various sizes by changing tool free and setting free change-parts, without making any considerable alteration in the existing setup of the device.
6. Another object of present invention is to provide a device for filling soluble containers such as capsules wherein sufficient provision and containment is available for loading of capsules for orientation and easy removal of excess capsules from orienter thereby facilitating easy handling of the orienter assembly.
7. An object of the present invention is to provide a device for filling soluble containers such as capsules wherein the device has an easily operable cam assembly mounted along with the assembly for filling capsules thereby facilitating sliding movement of sheets in filling assembly to enable quick and easier gripping of the body of the capsules.
8. An object of the present invention is to provide a device for filling soluble containers such as capsules wherein the device has a easily replaceable spacer plate for each size of capsule, to suit the body length of the capsule thereby providing a setting free change-part configuration.

9. An object of the present invention is to provide a device for filling soluble containers such as capsules wherein the device has an open structure, enabling visual operation during filling of capsules and also minimizes wastage of capsules.
10. An object of the present invention is to provide a device for filling soluble containers such as capsules wherein the device is capable of over encapsulation of smaller capsules, tablets, caplets and so on, with larger capsules.
11. An object of the present invention is to provide a device for filling soluble containers such as capsules wherein the device is capable of being used for orienting, separating the cap and body, and filling of capsules which have longer cap length and smaller body length such as double blind capsules.

SUMMARY OF THE INVENTION

According to the present invention, a device for filling soluble containers such as capsules comprises an assembly for orienting capsules wherein the sheets in the assembly for loading and orienting the capsules are capable of being relatively displaced and such displacement is limited by one or more slots in one or more of the sheets preferably in the sheet which is foremost in position from the upper side.

A gate comprising atleast a pair of tabs in the orienter assembly facilitates containment of the capsules loaded thereon to the orienter assembly.

Inclined holes are provided for orienting larger size capsules such as size 000, 00el, thereby improving versatility and widening of application range without increasing the size of filler and/or reducing the capacity of filler per cycle.

An easily operable eccentric cam assembly is mounted in the assembly for filling capsules so as to enable relative sliding movement of a set of sheets for effecting gripping of the body of the capsules such that the caps of the capsules can be separated manually from the gripped body of the capsules.

A set of locating holes preferably eight in number are disposed on the foremost sheet in the filler assembly, for enabling over encapsulation of smaller capsules, tablets, caplets, into bigger capsules.

In the assembly for filling capsules, the sheets have profile-cut portions and profile-cut strips that are capable of being positioned in mating relationship with each other to enable gripping the body of the capsules in a single plane thereby enabling separation of capsules having longer cap length and shorter body length.

BRIEF DESCRIPTION OF DRAWINGS

To complement the description that is being given and in order to promote a better understanding of the characteristics of the invention in accordance with a practical embodiment of the same and as an integral part of the said description a set of drawings accompany it in which, in an illustrative and non-restrictive way, the following are represented.

DETAILED DESCRIPTION OF THE INVENTION

The present invention discloses an inventive filling device for soluble containers such as capsules.

The device comprises an orienter assembly, a filler assembly, a capsule tray assembly, a powder tray and a tamper unit along with a accessories.

In this application the term capsule is used for the purposes of illustration only. It is not to be construed that the description refers only to the capsules but also includes all forms of containers and objects of such forms.

Orienter Assembly

The orienter assembly is capable of orienting about 50 or more capsules at a time. The orienter assembly is capable of orienting about 100 or more capsules in two stages in the same capsule filling cycle.

Figure 1:
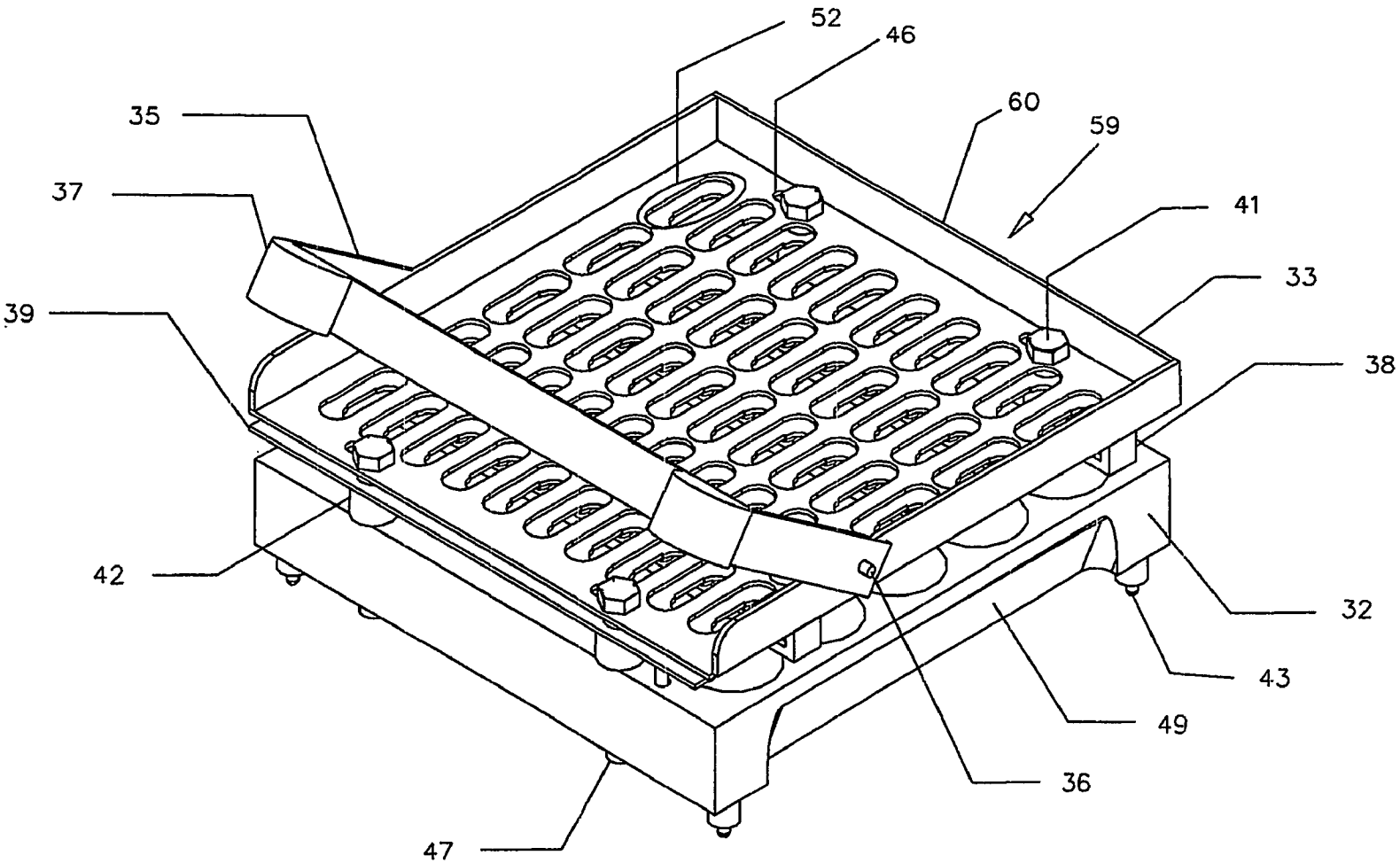
FIG. 1 is an isometric view of orienter assembly according to the present invention.
Figure 2:
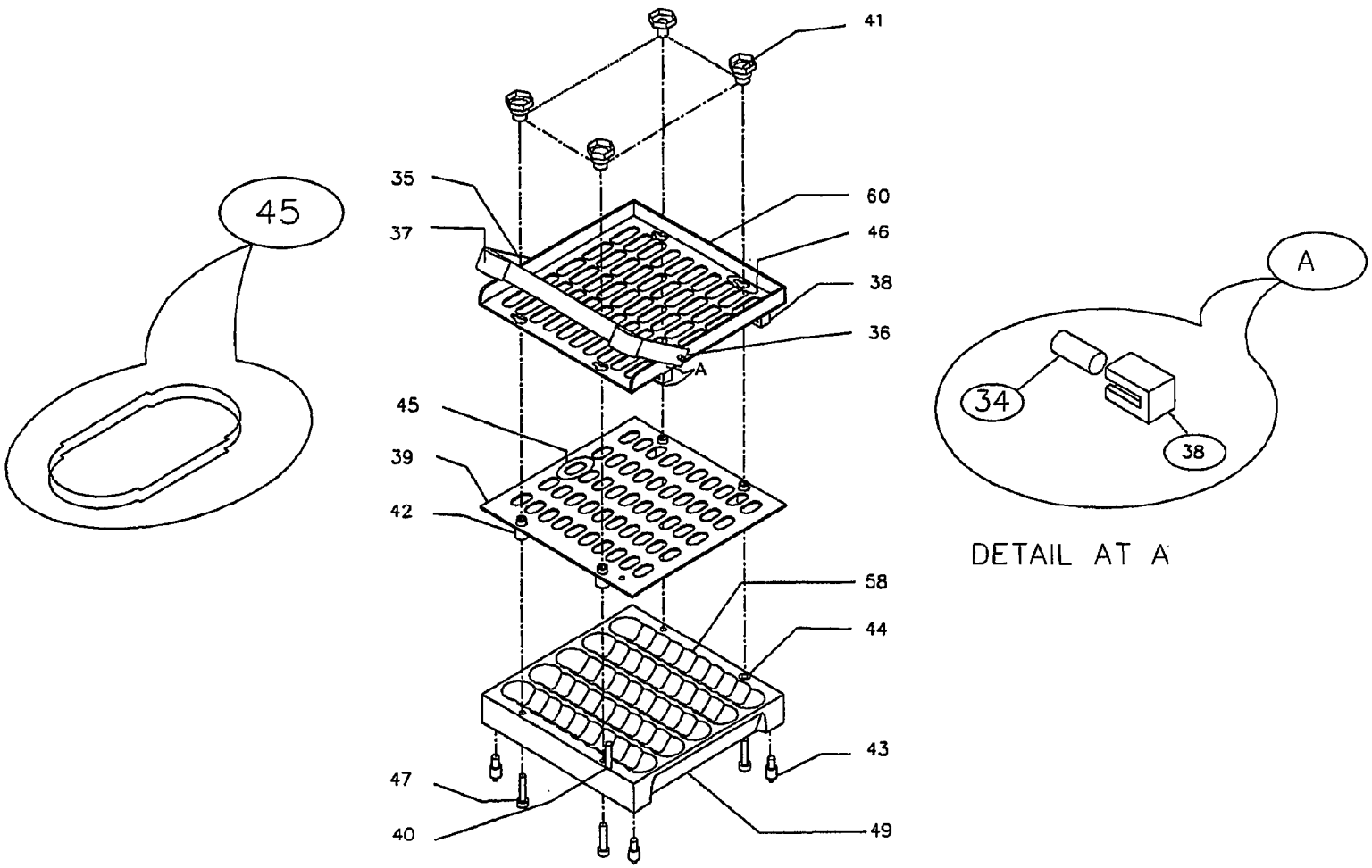
FIG. 2 is an exploded isometric view of orienter assembly according to the present invention.
Figure 3:
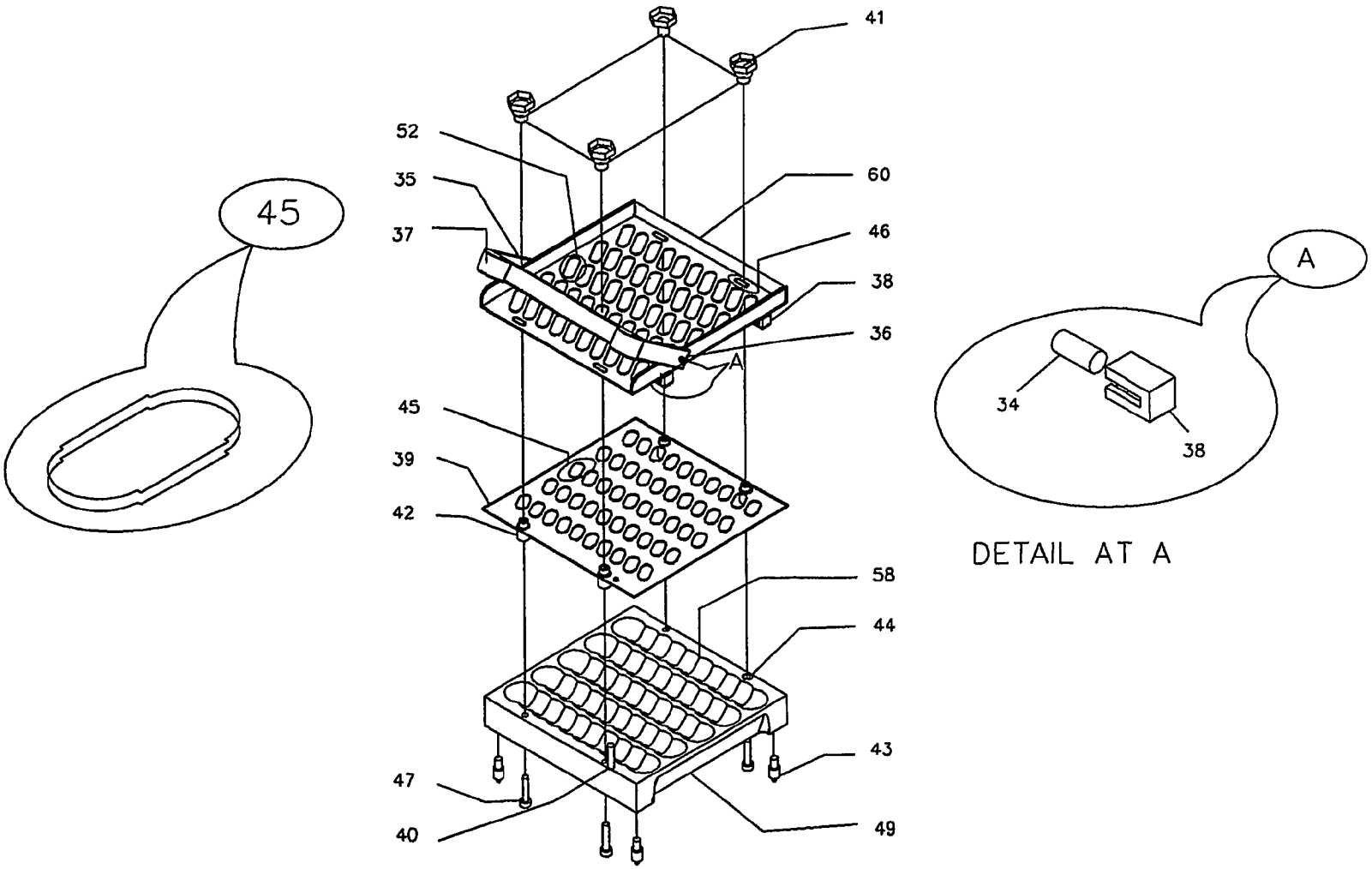
FIG. 3 is an exploded isometric view of orienter assembly according to one embodiment of the present invention

Referring to FIGS. 1, 2 and 3, an orienter assembly comprises a base (32) and a sheet unit (59) supported over the base (32). The base (32) preferably has a generally rectangular body having a locating foot (43) preferably four in number mounted individually at each corner, at the bottom surface of the base (32). The base (32) comprises a pair of cut-outs (49) for hand gripping, to facilitate holding of the orienter assembly by the operator. The base (32) may be made out of a metal or a plastic material preferably polycarbonate/acrylic material. The purpose of the locating foot (43) is to enable positioning of the orienter assembly, over a capsule tray assembly on filler assembly. The base (32) comprises several holes (58) preferably funnel shaped, which are adapted to allow and guide the passage of individual capsules from upper side of the base (32) to the lower side of the base (32), without effecting any change in the position of the oriented capsules. The base (32) has a locating pin (40) for mistake-proof assembly of the oriented sheet unit (59) over the base (32).

The sheet unit (59) comprises a top sheet (33) and a bottom sheet (39) assembled together using a set of screw bushes (42) and a set of top screws (41). The sheet unit (59) is mounted over the base (32) through a set of screw bushes (42) preferably four in number individually mounted such that the support of the sheet unit (59) is effected substantially from the four corners of the body of the base (32) through the screw bushes (42) as best illustrated in FIG. 1. Further, the sheet unit (59) is firmly fastened on to the body of the base (32) by a set of screws (47) preferably four in number which are introduced from the bottom of the base (32).

The top sheet (33) has a tray type configuration and is capable of accommodating about 50 or more capsules at a time. A plurality of ribs (60) are provided individually atleast in three out of four side edges and a gate (35) is disposed at one side edge of the top sheet (33) which is open and which is devoid of ribs (60). The gate (35) is configured at the side edge where the rib (60) is not present and such side, when in capsule orienting position, is towards the operator. The gate (35) is fixed onto the ribs (60) as shown in FIG. 1 using a pair of pivot pins (36) so that the gate (35) is disposed movable vertically, preferably in a circular path about the pivot pins (36). A pair of tabs (37) is integrally mounted substantially at either ends of the gate (35). The tabs (37) may also be configured in desired sizes and numbers and as a separable attachment. The gate tabs (37) serve two purposes. Firstly, the gate (35) is opened and closed by the operator, by holding the gate tabs (37) using thumbs. Secondly, because of the tare weight of the gate tabs (37) the gate (35) remains in closed position unless and until opened by the operator. In one position whereby the operator lifts the gate (35), the gate (35) is moved upwards whereby one side edge of the top sheet (33) is open and in the normal position of the gate (35), the gate (35) remains at a lower position, enabling closure of the open side edge of the top sheet (33) due to the tare weight of the gate tabs (37). This eliminates wastage of capsules falling out from the top sheet (33) due to accidental opening of the gate (35), during shaking of the orienter assembly.

The top sheet (33) has a plurality of notches (52) each having substantially elliptical shape and such notches (52) are preferably configured in 50 or more in number. The purpose of the top sheet (33) is to temporarily accommodate the capsules that are required to be filled with required contents and for transferring them onto the bottom sheet (39) by passage of the capsules through the notches (52). Preferably, slots (46) are provided in the top sheet (33), at positions corresponding to fastening location of the top screws (41). The slots (46) are dimensioned suitably just to enable horizontal sliding movement of the top sheet (33) relative to the position of the bottom sheet (39). The slots may also be in the bottom sheet (39) or in both top sheet (33) and bottom sheet (39). A spring block (38) is integrally mounted at the under surface of the top sheet (33). The provision of the slot (46) in the top sheet (33) reduces frictional contact area of sliding, and thereby friction less and smooth sliding is achieved. A spring (34) co-ordinates with the spring block (38) to effect reversible horizontal movement of the top sheet (33) relative to the bottom sheet (39). According to the present invention, the top sheet (33) is preferably a one piece fabricated construction for the purpose of easy cleaning, as gaps those would have been there due to multiple piece construction are avoided.

The top sheet (33) and the bottom sheet (39) are separated vertically by a predetermined distance in-between so as to make the capsules sit perfectly in the notches (52) & to prevent them from coming out of the notches (52) during shaking of the orienter assembly. The distance between the top sheet (33) and bottom sheet (39) is set between the optimum ranges as given in TABLE-1.

TABLE 1

| | Capsule size | | | | | | | | |
|---|---|---|---|---|---|---|---|---|---|
| | 000 | 00 | 0 | 1 | 2 | 3 | 4 | 5 | AA |
| Distance (mm) | 6.5 to 8 | 5 to 7 | 3.5 to 5.5 | 3.5 to 5.5 | 2.5 to 4 | 2.5 to 4 | 2.5 to 3.5 | 2 to 3 | 6.5 to 8 |

According to one embodiment of the present invention, the longitudinal axis of each notch (52) is kept at right angle to the gate (35) so that excess capsules can easily slide out without any interference from the capsules those are already seated in the notches (52) or dislodging the capsules seated in the notches (52), on tilting the orienter assembly.

The bottom sheet (39) has a plurality of profile notches (45), preferably 50 or more. The profile notches (45) preferably have a substantially elliptical shape with a wider section at the central portion as shown in the enlarged view in FIG. 2. accompanying the drawings. The significance of each profile notch (45) is to orient the capsules such that when the capsules fall from the notches (52) of the top sheet (33), and pass through the profile notch (45), the capsules are oriented with their body at the lower position and their caps at the top positions.

According to the present invention, the preferable dimensions of the central and end portions of the profile notch and the size of the capsules such as double blind capsules that are effectively handled in the profile notch are described in the following table No. 2:

All dimensions are in mm.

TABLE 2

| | | | | | |
|---|---|---|---|---|---|
| Caps. dims. | Cap Cut length | 11 to 13 | 17 to 19 | 13 to 15 | 10 to 12 |
| | Prelock Length | 18 to 20 | 24 to 25 | 19 to 21 | 16 to 17 |
| | Capsule# | AA | AAel | A | B |
| DB Or. | X | 20 to 22 | 25 to 27 | 20 to 22 | 16.5 to 18.0 |
| | Y | 10 to 12 | 14 to 16 | 10 to 12 | 7 to 9 |

wherein
"X" is the total length of the profile notch,
"Y" is the length of the central portion of the profile notch The capsules which remain in excess after being seated in the notches (52) can be easily slid out by tilting the orienter assembly without interference or dislodging the capsules that are seated in the notches (52). The profile notches (45) and notches (52) are laser cut in stainless steel SS-316 sheet to achieve required accuracy.

In an alternative embodiment, the notches (52) of the top sheet (33) and profile notches (45) of the bottom sheet (39) are oriented at an inclined position relative to the gate (35) see for instance FIG. 3 so that longer capsules such as size 000 capsules can be oriented without requirement of increasing the size of the assembly or reducing the capacity of filling wherein the capacity is defined as the number of capsules oriented per cycle.

Filler Assembly

Figure 4:
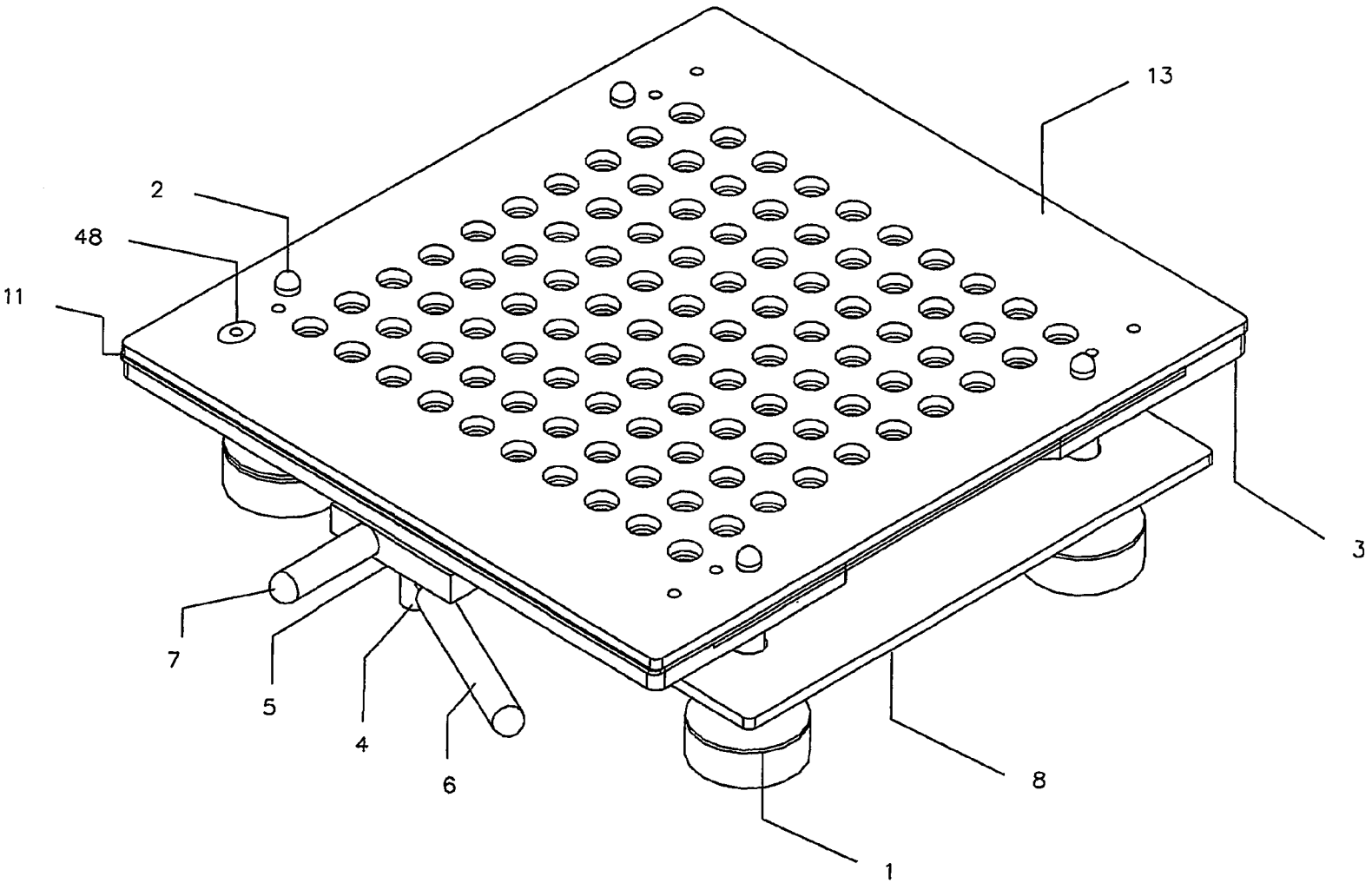
FIG. 4 is an isometric view of filler assembly according to the present invention.
Figure 5:
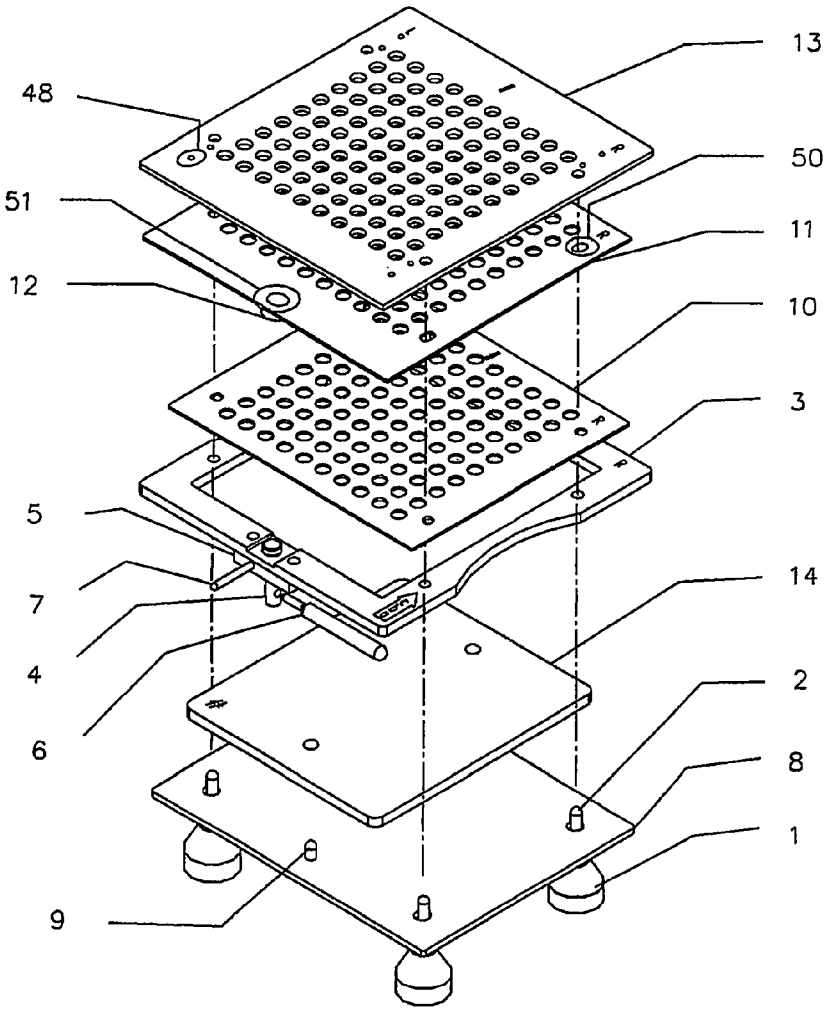
FIG. 5 is an exploded isometric view of filler assembly according to the present invention.

Referring to FIGS. 4 & 5, the filler assembly has a sheet unit mounted and located on a frame (3) with the help of pins (2), and a lifting plate (8) assembled together.

Figure 6:
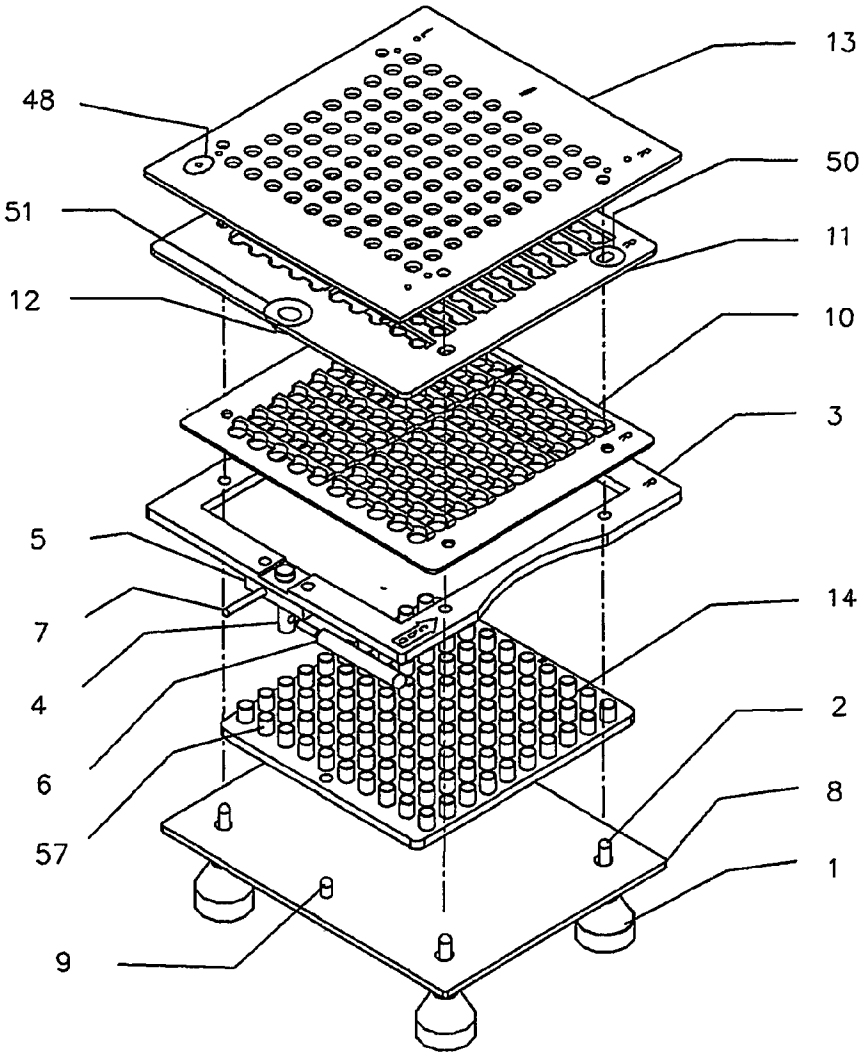
FIG. 6 is an exploded isometric view of the filler assembly according to one embodiment of the present invention.

The sheet unit comprises a top sheet (13), a bottom sheet (10) and a sliding sheet (11) which are adapted to move relatively in-between the top sheet (13) and the bottom sheet (10). The frame (3) has a cam support block (5). The cam support block (5) comprises a cam (4) having an integral cam handle (6), and is mounted at one edge of the frame (3), the edge preferably being towards the operator's side. The frame (3) is supported on the pins (2) preferably four in numbers. A spacer plate (14) is preferably interposed between the frame (3) and the lifting plate (8). A plurality of pins (57) as shown in FIG. 6 may be used in the spacer plate (14) for use with double blind capsules or the spacer plate (14) without pins as shown in FIG. 5 may be used for use with regular size capsules. The spacer plate (14) is located on the lifting plate (8) using a set of locating pins (9). Rubber feet (1) are affixed at the bottom of the pins (2), for supporting the lifting plate (8) and in turn the entire assembly.

A thumb post (7) is fixed on the cam support block (5), to keep the device stable while operating the cam (4), as the pressure applied by fingers to operate the cam (4) is balanced by the thumb post (7) through the thumb. Without thumb-post (7), the operator would have to hold the machine in awkward position with one hand while he moves the cam handle (6) with the other hand. The provision of the thumb post (7) enables achieving single hand operation of the device.

A cam slot (51) is provided in the sliding sheet (11), which is in engagement with the cam (4) such that when the operator operates the cam (4) by holding the thumb post (7) in one hand and turning the cam handle (6), the engagement of the cam (4) with the sliding slot (51), the sliding sheet (11) is relatively moved along the horizontal direction, with respect to the top sheet (13) and bottom sheet (10).

A cam bush (12) is welded onto the sliding sheet (11) from bottom side, at the vicinity of the slot (51). The sliding sheet moves forward & returns back to home position positively when the cam (4) is operated (rotated) clockwise & anti-clockwise respectively for separation of caps & bodies of the capsules. The cam (4) is preferably a single eccentric cam which operates preferably only one sheet i.e. sliding sheet (11). The cam can be designed to operate more than one sliding sheet. The holding of the capsule body for separation can be achieved by a two plate system or a three or more plate system, with one plate sliding or two or more plates sliding. For replacing the sheets for filling other size capsules, dismantling of cam from the base frame is not required.

The device capacity is preferably 100 capsules per cycle however it can have any higher capacity required i.e 200, 300, or 500 or more capsules per cycle.

The device is manually operated. Optionally, it can be adapted to be operated using pneumatics, hydraulics, hydro-pneumatic, electro-pneumatic, mechanical linkages and other similar powered or non-powered mechanisms.

A set of locating holes (48) preferably eight in number are provided in the top sheet (13) for locating an orienter assembly for over encapsulating capsules with size smaller than the size of the capsules on filler by orienting and dropping filled capsules. Alternatively the locating holes (48) could locate a tablet/caplet filling attachment for orienting and dropping tablets/caplets into the capsule bodies.

Figure 7:
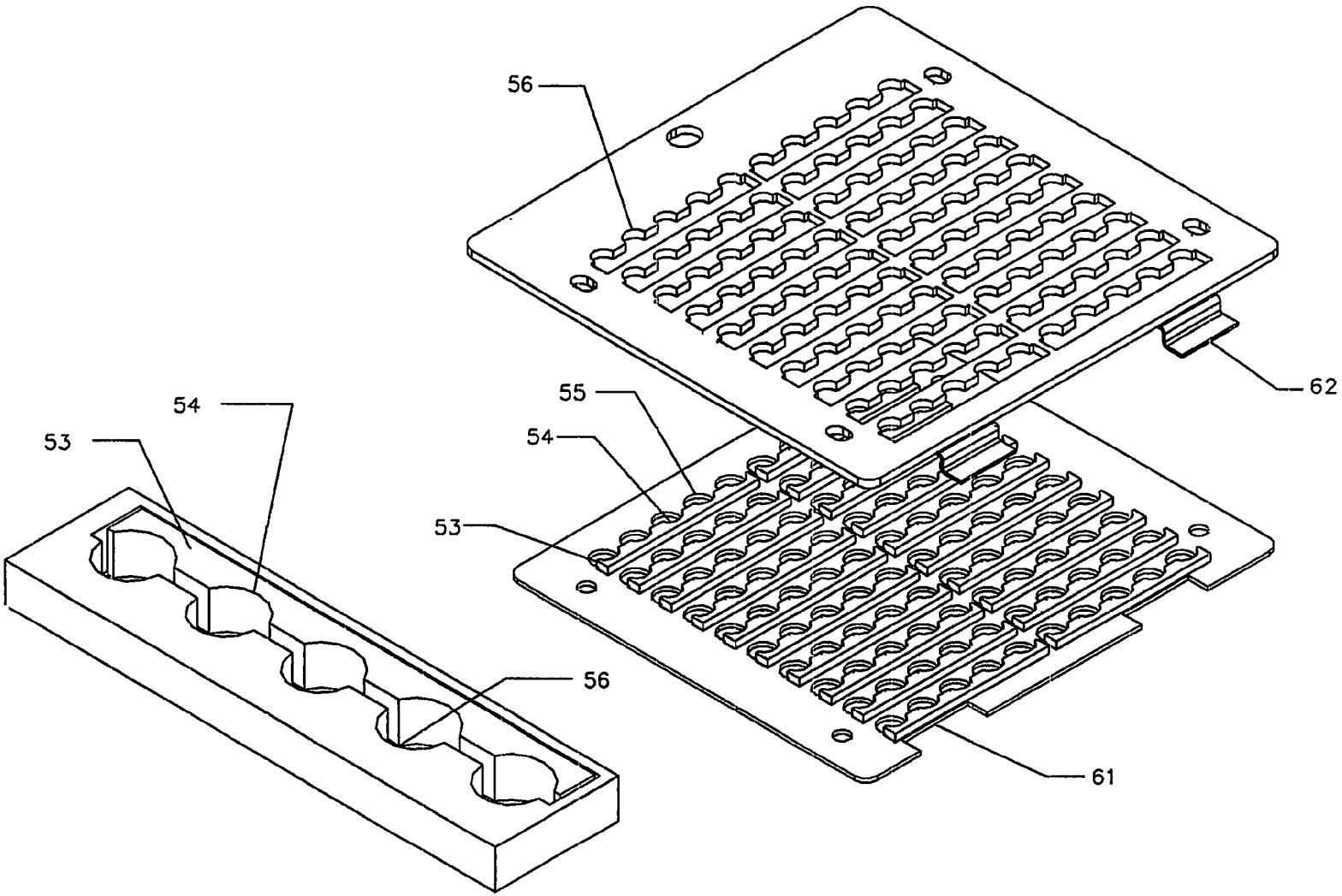
FIG. 7 is an exploded isometric view of sliding sheet and bottom sheet of the filler assembly according to the present invention.

Referring to FIGS. 6 & 7, according to another embodiment of the present invention, the sheet unit of the filler assembly comprises a top sheet (13) a bottom sheet (10) and a sliding sheet (11) wherein the sliding sheet (11) has a plurality of profile-cut portions (56) as best illustrated in FIG. 7. The bottom sheet (10) comprises a plurality of profile-cut strips (53) of thickness 2 to 4 mm, welded to its upper surface. Each profile-cut strip (53) is in rectangular flat form having multiple circular cut portions (54) on one side along its longitudinal edge. Each circular cut portion (56) is concentric with corresponding holes (55) provided in rows and columns in the bottom sheet (10). The profile-cut portions (56) of the sliding sheet (11) are capable of being positioned in matching relationship with the profile-cut strips (53) of the bottom sheet (10). In the matched position of the profile-cut portion (56) of the sliding sheet (11) and the profile-cut strips (53) of the bottom sheet (10), the circular cut portion (54) of the profile-cut strips (53) and the profile cut portion (56) of the sliding sheet (11) forms a circular through hole sufficient enough to allow the body of the capsule to pass through. The body of the capsule is gripped in a single plane formed by the coordinating effect of the profile-cut strips (53) of the bottom sheet (10) and the profile-cut portions (56) of the sliding sheet (11). When the sliding sheet (11) is moved 1 to 2 mm relative to the bottom sheet (10), the body of the capsules is gripped so that the caps can be separated apart manually from the body of the capsules. To prevent lifting of the sliding sheet (11) during separation operation, a pair of holding strips (62) is disposed preferably welded to bottom surface of the sliding sheet (11) on the side opposite to the operator's side. To accommodate the holding strips (62), cut-outs (61) are provided on the bottom sheet (10).

Capsule Tray Assembly

Figure 8:
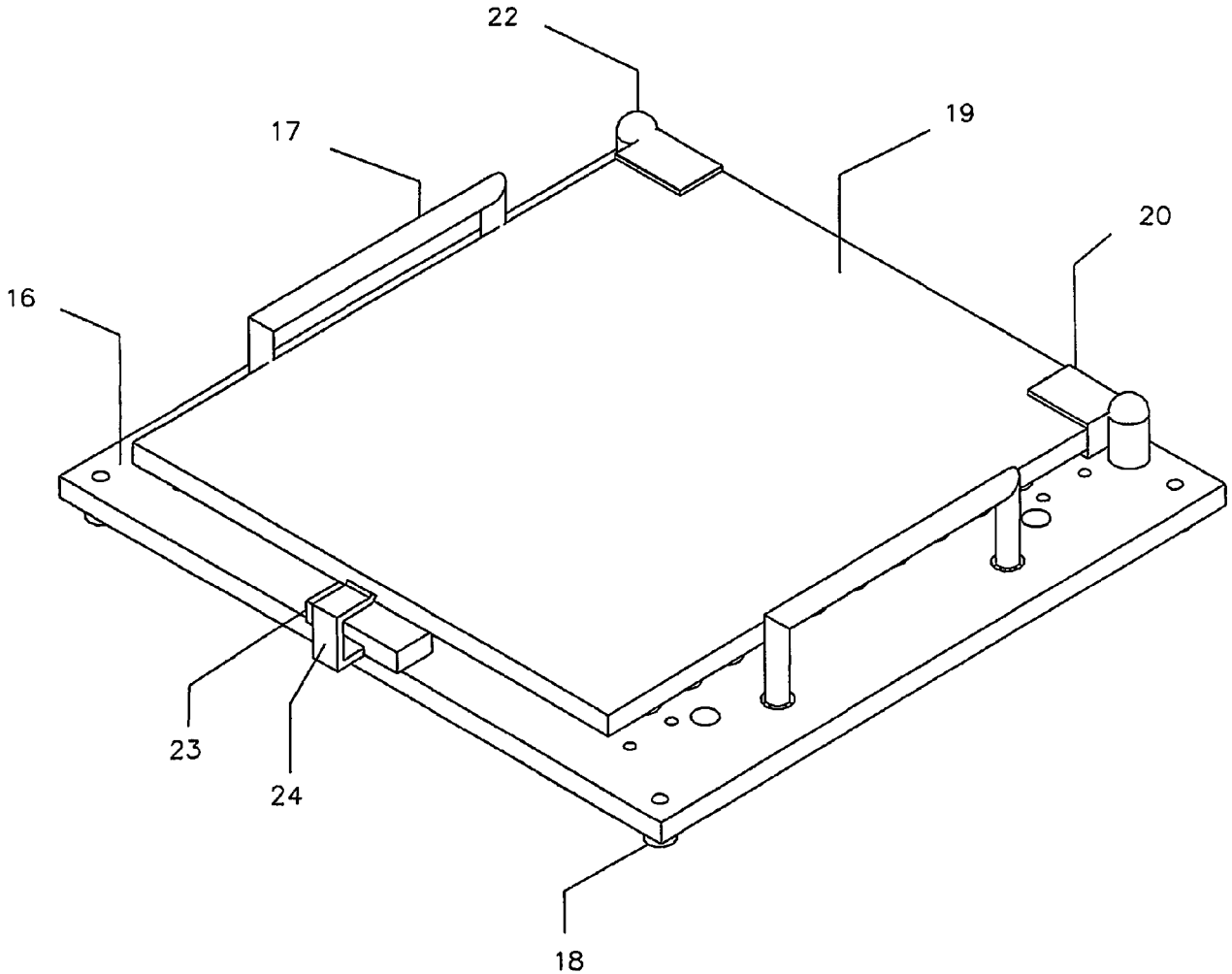
FIG. 8 is an isometric view of capsule tray according to the present invention.
Figure 9:
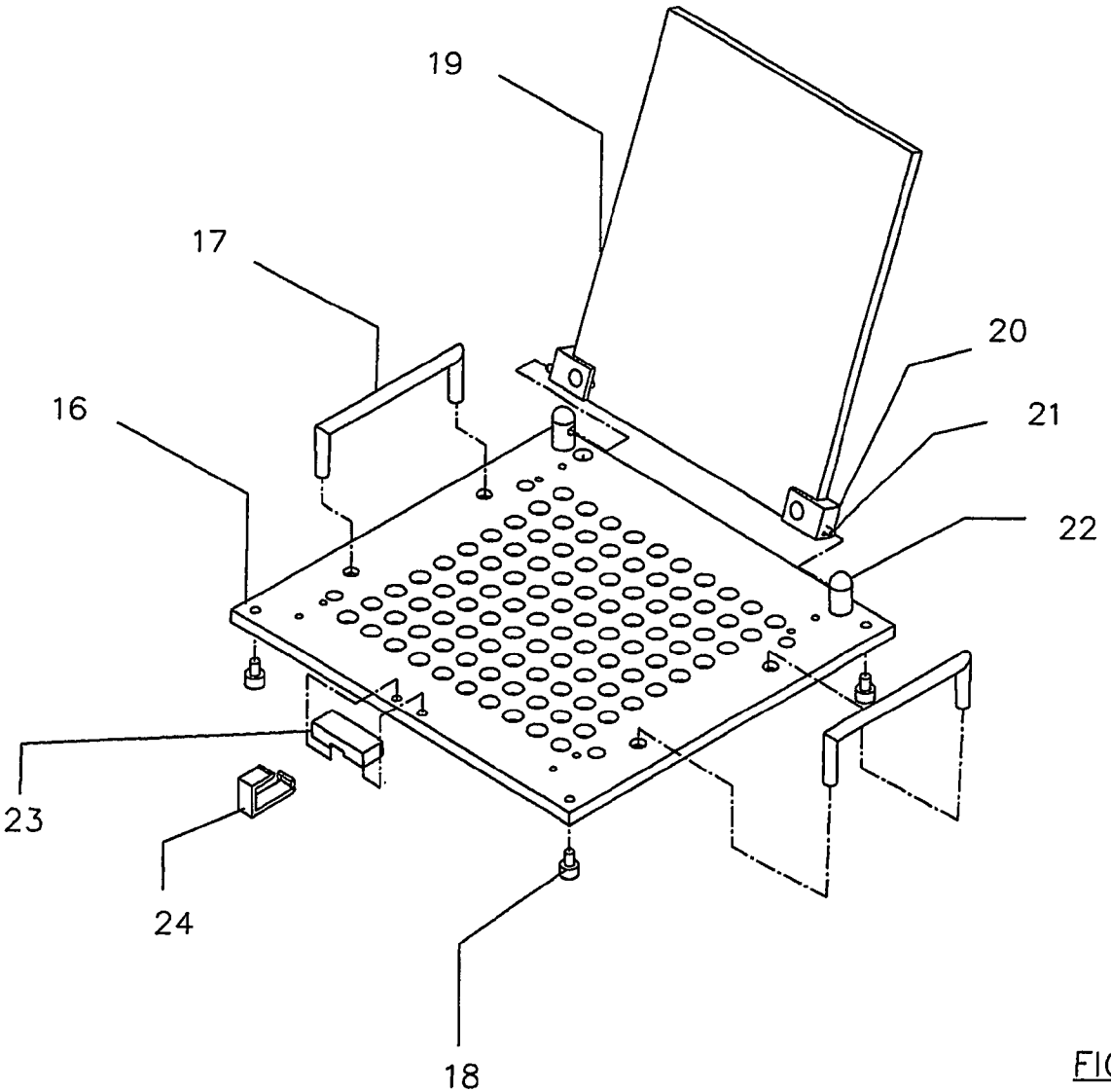
FIG. 9 is an exploded isometric view of capsule tray according to the present invention.

Referring to FIGS. 8 & 9, the capsule tray assembly comprises a capsule tray (16) having a plurality of holes preferably 50 or more in number for accommodating capsules. A pair of hinge posts (22) is individually provided preferably at two corners along one side edge of the capsule tray (16). A pair of handles (17) is mounted individually to the holes provided on either sides of the capsule tray (16) as illustrated in FIG. 9. A locking plate (19) is mounted to the hinge posts (22) such that the locking plate (19) openably closes the holes provided in the capsule tray (16). A pair of hinge brackets (20) with hinge pins (21) is fixed individually on either side edges of the locking plate (19) to facilitate mounting of the locking plate (19) on to the hinge posts. Supporting feet (18) are detachedly affixed at the four corners, at the bottom side surface of the capsule tray (16).

The feet (18) are preferably four in number and are provided on the capsule tray (16) to avoid popping out of caps after capsule separation is done. Novice users of machines will at times unlock and open the locking plate (19). If the capsule tray (16) does not have the capsule tray foot (18) and the capsule tray (16) is placed on the table, all the caps in the capsule tray (16) will pop out due to entrapped air.

A resting block (23) is mounted along one side edge, at the upper surface of the capsule tray (16). Preferably the resting block (23) is mounted along the side opposite to the side of the hinge posts. A clamp (24) is used to hold the locking plate (19) with the capsule tray (16) when in that position, one edge of the locking plate (19) rests over the resting block (23).

In horizontal position, the locking plate (19) rests on the resting block (23) leaving small gap between capsule top position and the locking plate bottom to avoid any damage to capsules due to weight of locking plate (19). The clamp (24) locks the locking plate (19) in place. The clamp (24) is very easy to operate & gives positive locking of the locking plate in one step.

The capsule tray (16) is mounted and located on the filler assembly using the pins (2).

Accessories

Figure 10:
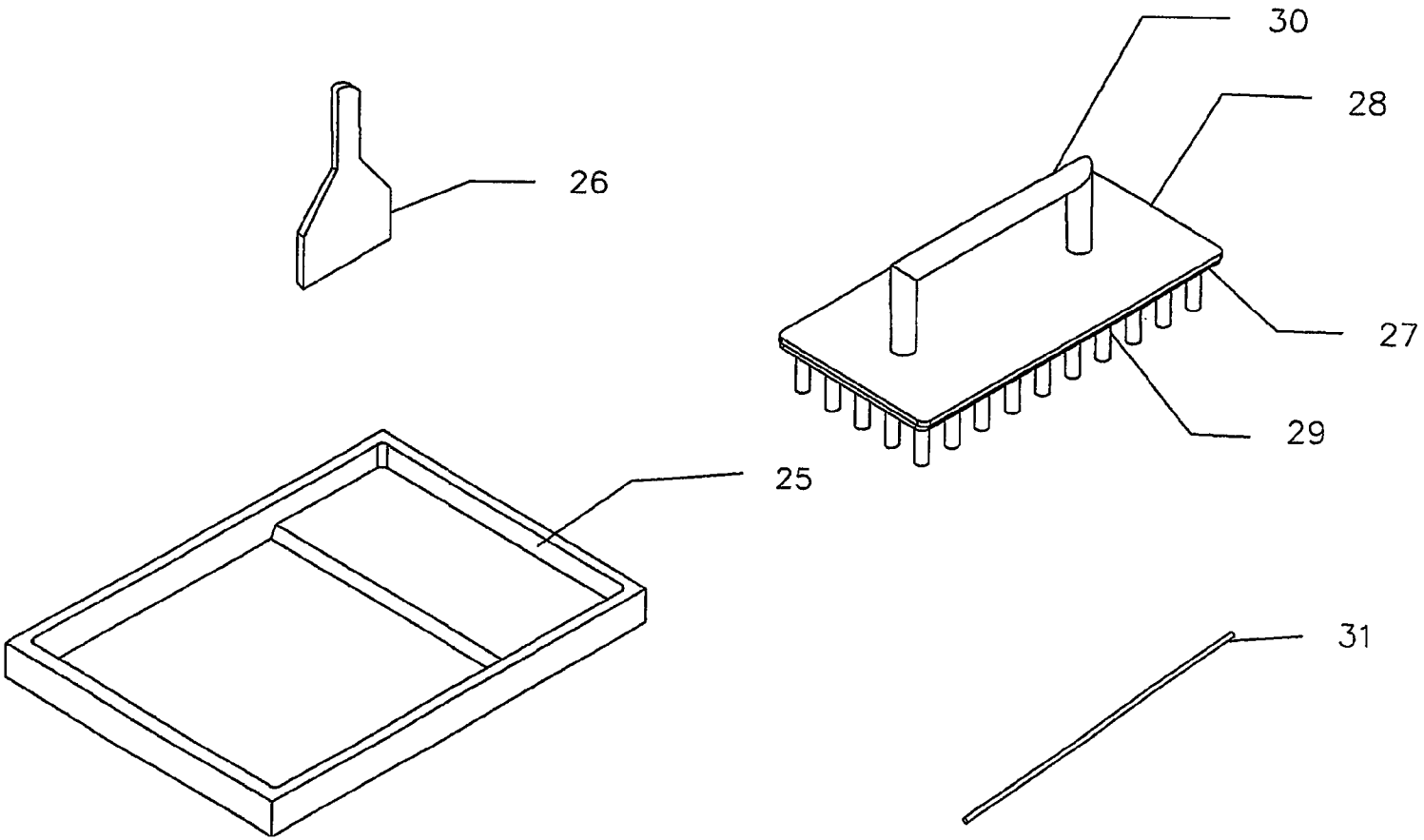
FIG. 10 is an isometric view of tamper, powder spreader, and extractor rod & powder tray according to the present invention.

Referring to FIG. 10, the accessories include a powder tray (25) for temporarily accommodating the powder material to be filled in the capsule, a spreader (26) for evenly spreading the powder material accommodated in the powder tray (25) and a tamping device for pushing-in the material filled in the capsules. An extractor rod (31) is used to extract the jammed capsules from the orienter assembly. The powder tray (25) is fabricated as a single piece for enabling easy cleaning.

The tamping device comprises a cover plate (28) attached on to a bottom plate (27). The bottom plate (27) has a plurality of equally spaced tamping pins (29) for applying pressure over the powder material filled in the capsules. A handle (30) is integrally fixed or alternatively screwed onto to the upper surface of the cover plate (28), to enable gripping of the tamping device by user. Preferably 50 or more tamping pins are fitted to the bottom plate.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A device for filling soluble containers comprising:

(a) an assembly for orienting capsules;

(b) an assembly for filling capsules;

wherein said assembly for orienting capsules comprises at least one sheet component for orienting capsules and at least one base component for guiding the oriented capsules there through to a following assembly:

said sheet component comprising at least one first sheet and at least one second sheet; said sheets being set apart and capable of being displaced relatively to each other;

said first sheet comprising a plurality of ribs provided individually at least in three out of four side edges of the sheet and a plurality of notches for accommodating the capsules loaded thereto, in coordination with said second sheet;

said second sheet comprising a plurality of notches adapted to substantially orient the capsules into filling position; wherein the assembly for orienting capsules comprises at least one displacement limitation means in at least one of said sheets, wherein said displacement limitation means includes at least one slot for sliding, said slot located in at least a first sheet or in at least a second sheet or in combination thereof, and a screw extending from said slot to limit relative displacement of said first sheet with respect to said second sheet.

2. The device according to claim 1 wherein said first sheet comprises an opening and closing means adapted movably at an open side of the first sheet, having at least a pair of thumb operable tabs for opening and closing and for retaining said opening and closing means in a substantially closed position while said opening and closing means is in a non-operated state.

3. The device according to claim 1 wherein the longitudinal axes of notches in a first sheet are inclined relative to the length of the opening and closing means.

4. The device according to claim 3 wherein the longitudinal axes of notches in the first sheet are orthogonal to the length of the opening and closing means.

5. The device according to claim 1 wherein the first sheet and the second sheet are configured as a sub-assembly and is capable of being used as a change-part in pre-assembled condition.

6. The device according to claim 1 wherein the base component comprises at least four locating feet for supporting and locating the assembly for orienting capsules.

7. The device according to claim 1 wherein the distance between the first sheet and the second sheet is maintained by screw bushes such that the capsules sit perfectly within the notches without jumping off from a seated position.

8. The device according to claim 1 wherein the notches of the second sheet comprise a first section and a second section wherein the size of the first section and the second section are configured in relation to the size of the capsules.

9. The device according to claim 1 wherein the assembly for filling capsules further comprises a sheet component for holding a portion of capsules and thereby facilitating separation of a body portion and a cap portion of each of the capsules; and comprising a capsule tray adapted to form a gap to release entrapped air inside the cap portion and thereby avoid popping out of the cap portion of the capsules after separation into the body portion and the cap portion.

10. A device for filling soluble containers comprising:

(a) an assembly for orienting a plurality of capsules;

(b) an assembly for filling capsules;

wherein said assembly for filling capsules comprising:

a sheet component for holding a portion of capsules and thereby facilitating separation of a body portion and a cap portion of the capsules resulting in separated capsules, and a base component for supporting a portion of the separated capsules;

said sheet component comprising at least a pair of sheets and each of said sheets having a plurality of holes therein to allow passage of capsules therethrough for holding of a portion of each of the capsules for facilitating separation into the body portion and the cap portion wherein at least one of such said sheets is displaceable relative to one or more sheets for effecting gripping of a portion of the capsules during separation of the body portion and the cap portion of capsules;

said base component comprising a displacement means for effecting relative displacement of said sheets without removing the displacement means wherein the displacement means is a cam assembly mounted to the base component.

11. The device according to claim 10 wherein the sheets are replaceable for filling other size capsules without removing a cam.

12. The device according to claim 11 wherein the cam is an eccentric cam having an offset distance of at least 1 mm.

13. The device according to claim 10 wherein the base component comprises a thumb post to facilitate operation of the displacement means by an operator's thumb.

14. The device according to claim 10 wherein the sheet positioned at a foremost position from the upper side comprises at least eight locating holes for locating an orienter assembly for over encapsulation.

15. The device according to claim 10 wherein the sheets are adapted to hold the body portion of the capsules in a single plane for enabling separation of the body portion and cap portion of the capsules.

16. The device according to claim 10 wherein the sheets have profile-cut portions and profile-cut strips that are capable of being positioned in a mating relationship with each other to enable gripping the body portion of the capsules in a single plane for enabling separation of the body portion and cap portion of the capsules.

17. The device according to claim 10 further comprising a capsule tray adapted to form a gap to release entrapped air inside a plurality of cap portions of the capsules and thereby avoid popping out of the cap portion of the capsules after separation into the body portion and the cap portion.

18. The device according to claim 10 wherein one of the sheet components is displaced by sliding for enabling the separation of the body portion and cap portion of the capsule.

19. The device according to claim 18 wherein one eccentric head cam displaces one of the sheet components by sliding.

20. The device according to claim 10 wherein the assembly for filling capsules further comprises a capsule tray adapted to form a gap to release entrapped air inside the cap portion and thereby avoid a popping out of the cap portion of the capsules after separation into the body portion and the cap portion.

* * * * *